United States Patent [19]

Owen

[11] 4,455,736

[45] Jun. 26, 1984

[54] STAPLE REMOVING APPARATUS

[75] Inventor: Trevor W. Owen, Mississauga, Canada

[73] Assignee: Owen Tri-cut Limited, Mississauga, Canada

[21] Appl. No.: 367,863

[22] Filed: Apr. 13, 1982

[51] Int. Cl.³ ..... B26D 3/00

[52] U.S. Cl. ..... 29/564.3; 29/426.4; 83/105; 83/372; 83/391; 83/593; 254/28

[58] Field of Search ..... 254/28; 29/33 R, 426.4, 29/564.3; 83/105, 372, 593, 921, 391

[56] References Cited

U.S. PATENT DOCUMENTS

| | | | |
|---|---|---|---|
| 2,564,900 | 8/1951 | Henriksen | 29/426.4 X |
| 3,126,195 | 3/1964 | Taylor | 254/28 |
| 4,090,690 | 5/1978 | Nitzchneider | 254/28 |

*Primary Examiner*—James M. Meister

*Attorney, Agent, or Firm*—Rogers, Bereskin & Parr

[57] ABSTRACT

An apparatus for removing staples from paper, card and like sheet-form material is disclosed. The apparatus includes an anvil which deflects downwardly the leading end portion of a sheet inserted into the apparatus. A staple in the incoming sheet abuts against a tongue which causes the tongue to pivot rearwardly. The tongue is then moved towards the anvil to indent the paper adjacent the staple and orient the staple against the front face of the tongue. Next, the tongue is returned to a vertical position and the staple is pressed upwardly into a relieved portion of a rotary knife. The knife then slices off the top of the staple and removes the sliced off portion. Remaining portions of the staple are stripped from the paper as it is withdrawn from the apparatus.

9 Claims, 9 Drawing Figures

STAPLE REMOVING APPARATUS

This invention relates to an apparatus for removing staples from paper, card and like sheet-form material.

The invention has been devised primarily (but not exclusively) in the environment of automatic mail processing equipment. An example of such equipment is disclosed in U.S. Pat. No. 3,952,874 (Owen). Equipment of this type is widely used by credit card companies, utilities and the like for processing remittances. Typically, a remittance (e.g. a cheque) is accompanied by a remittance advice such as part of a credit card statement, and the two items (together called a "remittance set") must be separated for subsequent processing. If a paper clip, staple or other fastener has been used to secure the two items together, it is imperative that the fastener be completely and cleanly removed before the items are processed, otherwise extensive damage can result to the mail processing equipment or to data processing equipment used for crediting the particular account in question. Paper clips can be fairly easily removed, but staples in particular present a significant practical problem.

Experience has shown that a major credit card company or utility company can expect to receive many hundreds of stapled remittance sets each working day, despite specific requests to customers not to use staples. These stapled sets must be identified and segregated from the main stream and the staples manually removed before the remittances can be processed. Often, it is efficient to batch the segregated sets and manually remove the staples from all of the sets in the batch and then return them to the stream together. This is disruptive of the mail processing flow and is expensive both in terms of operator time and because of lost interest on the remittances involved. Again, experience has shown that the accumulative effect of this lost interest is significant.

An object of the present invention is to provide a staple removing apparatus suitable for use as part of an automated mail processing system. However, the invention is not limited to this particular application.

According to the invention there is provided an apparatus for removing staples from sheet-form material, the apparatus including means defining an elongate opening into which a sheet can be inserted generally in a flat plane with a staple to be removed from the sheet extending generally transverse to the direction of insertion. An anvil is provided and has a leading edge disposed generally in the plane and extending generally normal to the direction of insertion of the sheet. The anvil is adapted to deflect out of said plane the leading end portion of a sheet inserted into the opening. Stop means is also provided and is adapted to locate the staple in the sheet at a cutting station with portions of the staple at a first side of the sheet against the anvil leading edge. The stop means has a staple locating edge parallel to the anvil leading edge and positioned for contact by portions of the staple at the second side of the sheet. The apparatus also includes means adapted to engage the portions of the staple located against the stop means and to displace the staple toward the sheet so as to cause the staple to protrude from the second side of the sheet. Cutter means is provided and is operable to slice through the protruding portions of the staple along a cut line generally parallel to said flat plane and in a direction towards the anvil so that the staple is cut into portions which can readily separate from the sheet. A method of removing staples is also provided.

It is of course to be understood that the term "sheet" as used in the preceding paragraph is intended to include both single sheets and sets of two or more sheets secured together by a staple. Thus, in the minimum case, it might be necessary to remove a staple from a single sheet of paper, card or the like, while in most cases the staple will be engaged through two or more pieces of paper (e.g. a cheque and a remittance advice) in which case the set will be inserted into the opening in the apparatus for removal of the staple.

In a preferred embodiment of the invention, the stop means takes the form of a pivoted tongue which is pressed back by the incoming sheet until a position is reached at which the sheet is trapped between the staple-locating edge of the tongue and the surface of the anvil. The tongue will then be advanced to indent the sheet adjacent to the staple, which will have the effect of turning the staple to lie flat against the tongue. The tongue will then be pivoted back (against the direction of insertion of the sheet) while maintaining pressure against the anvil, until the portions of the staple adjacent the second side of the sheet locate against the leading edge of the anvil. This has the advantage of ensuring that the staple is disposed at the optimum orientation for cutting.

Preferably, the cutter means takes the form of a rotary knife; however, within the broad scope of the invention, a knife moveable rectilinearly could be used.

In order that the invention may be more clearly understood, reference will now be made to the accompanying drawings which illustrate a preferred embodiment of the invention by way of example, and in which, FIG. 1 is a perspective view of an apparatus according to the invention with the casing and some parts broken away to show internal structure;

Figure 2:
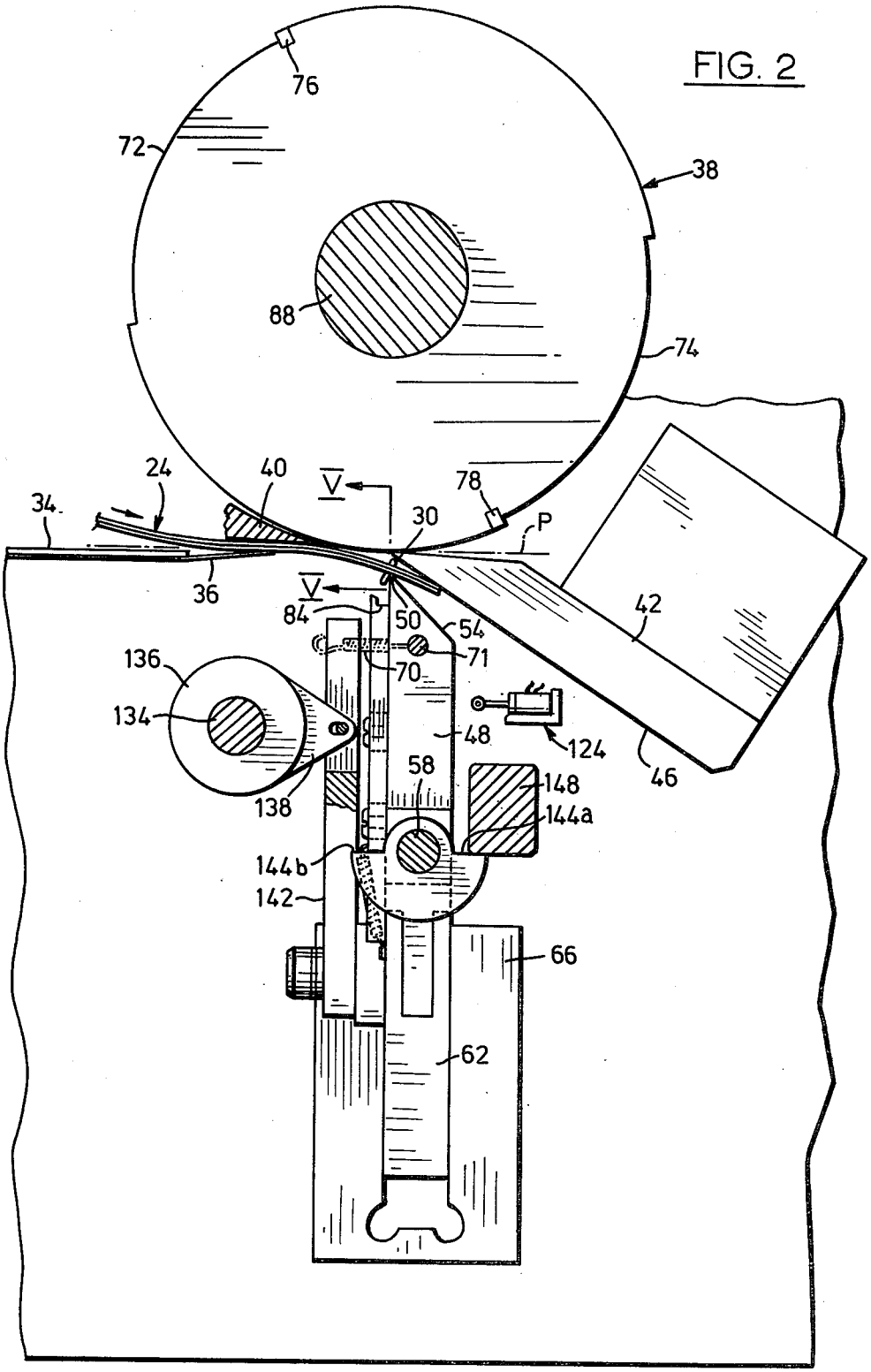
FIG. 2 is an end view (with some parts sectioned) on line II—II of FIG. 1, showing a remittance set inserted into the apparatus.
Figure 3:
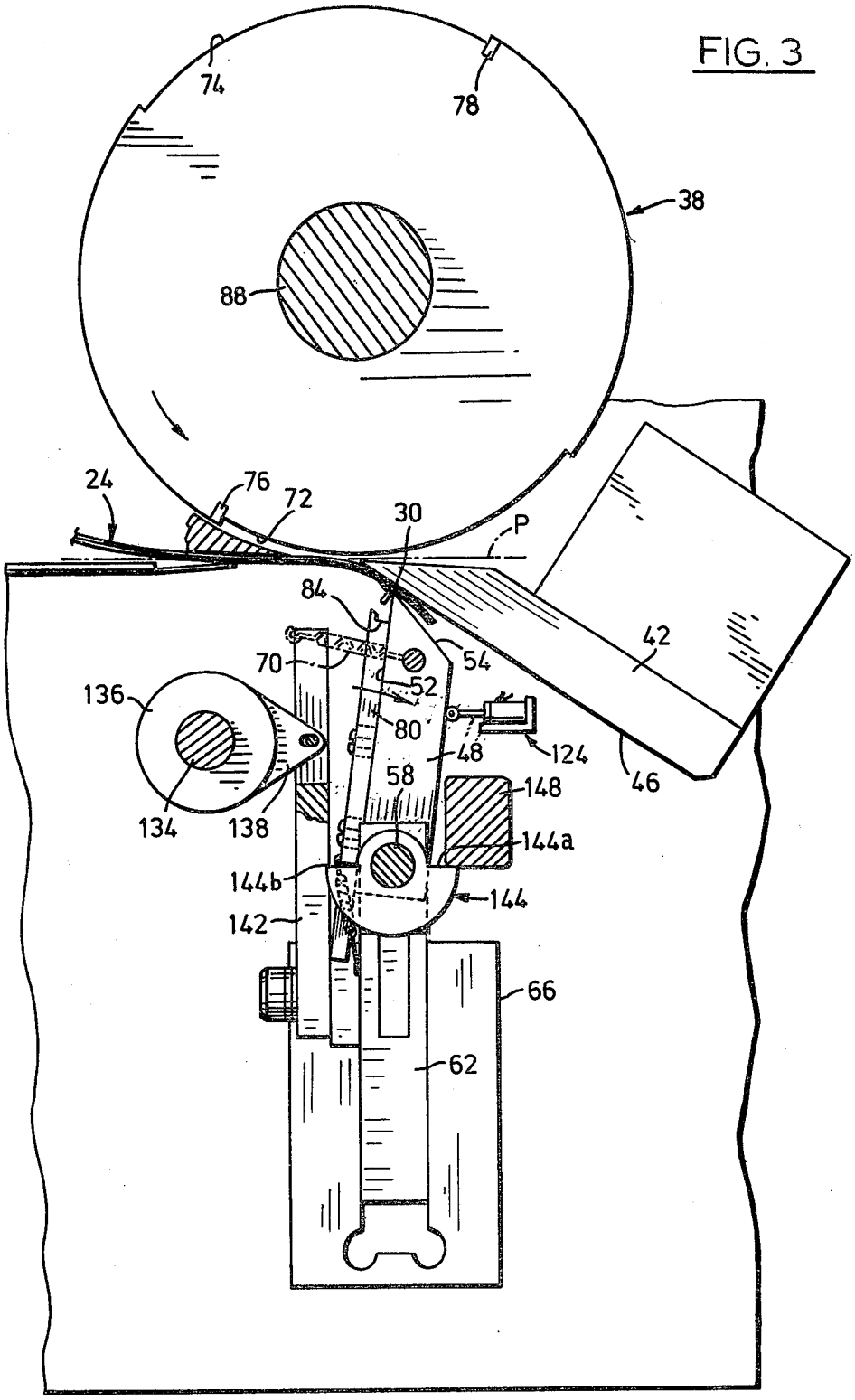
FIG. 3 is a view similar to FIG. 4 showing a subsequent step in the operation of the appratus.
Figure 3A:
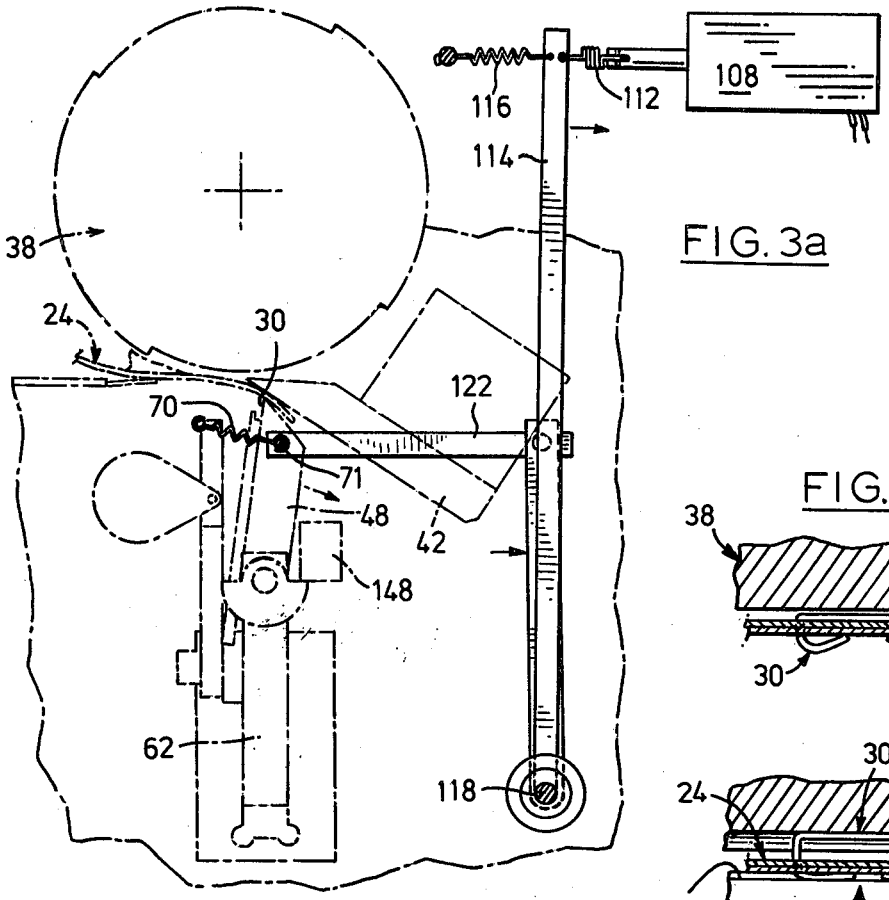
Figure 5:
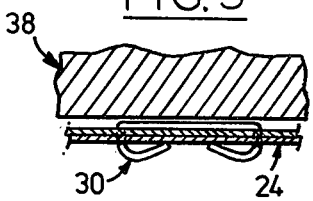
Figure 6:
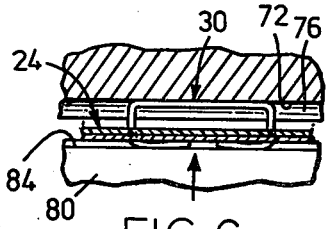
Figure 3B:
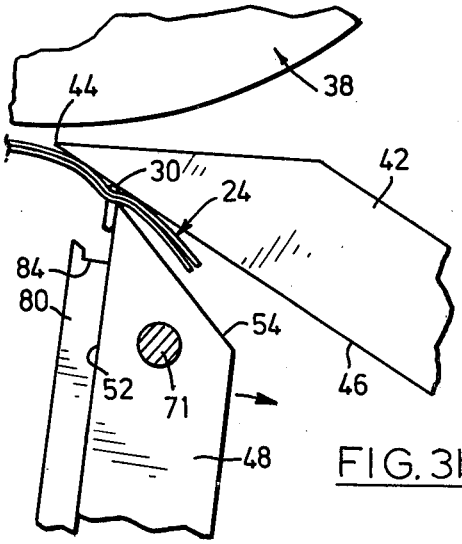
Figure 4A:
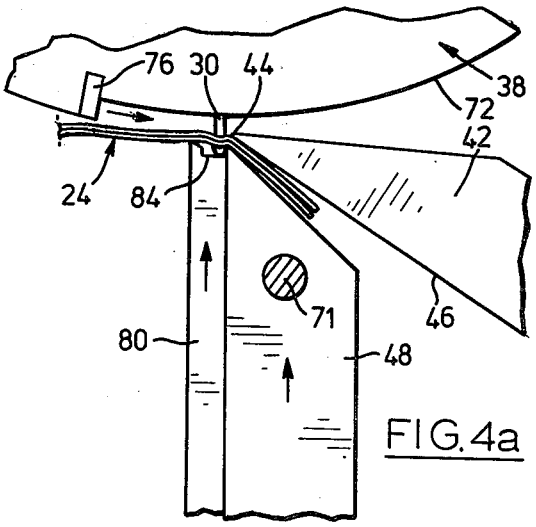
Figure 4:
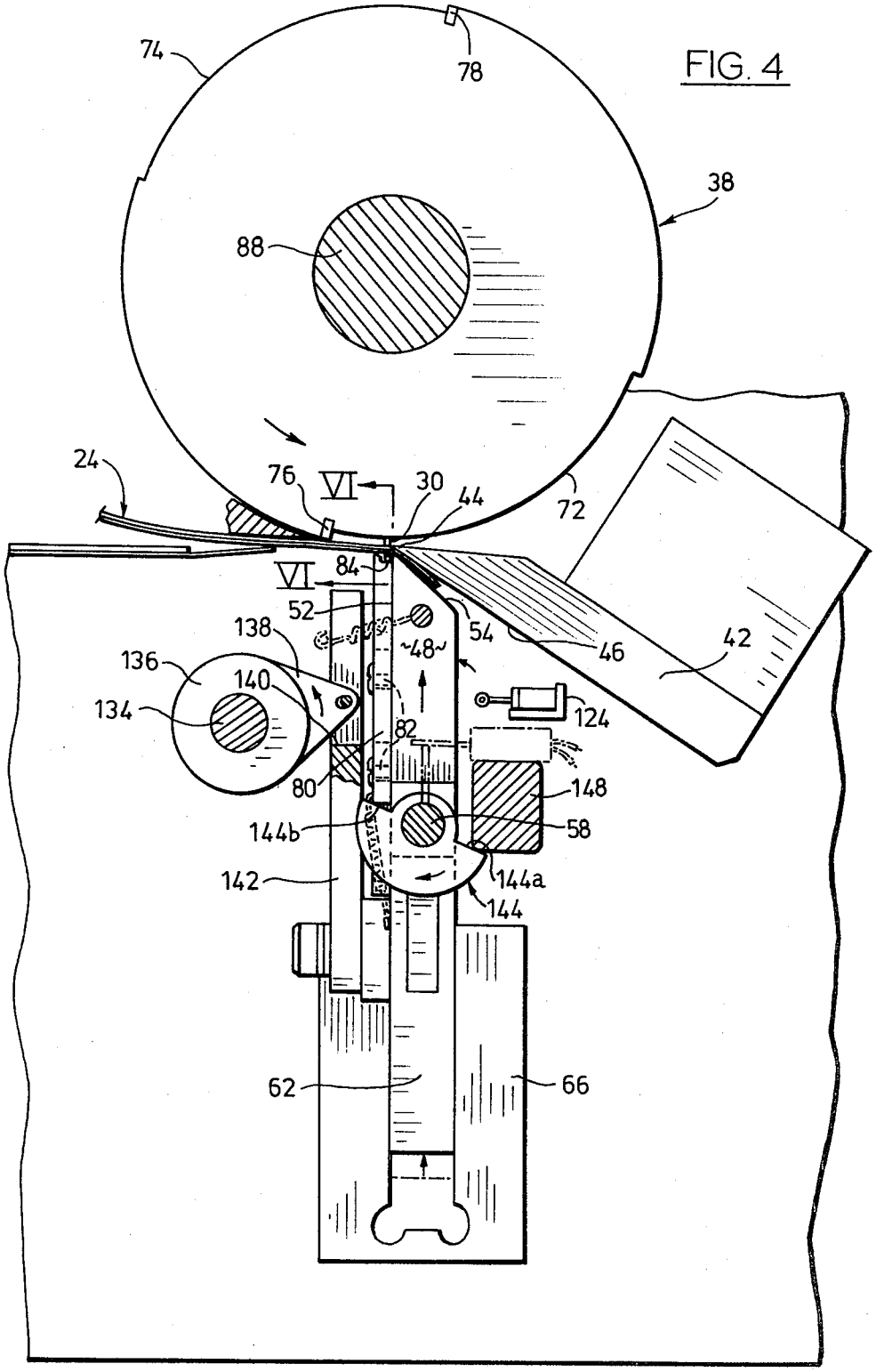

FIG. 3*a* is a diagrammatic view similar to FIG. 3 showing other parts not visible in FIG. 3;

FIG. 3*b* is an enlarged view of part of FIG. 3;

FIG. 4 is a view simiar to FIG. 3 showing a later step in the operation of the apparatus;

FIG. 4*a* is an enlarged view of part of FIG. 4; and,

FIGS. 5 and 6 are vertical sectional views on lines v—v and vi—vi of FIGS. 2 and 4 respectively.

Figure 1:
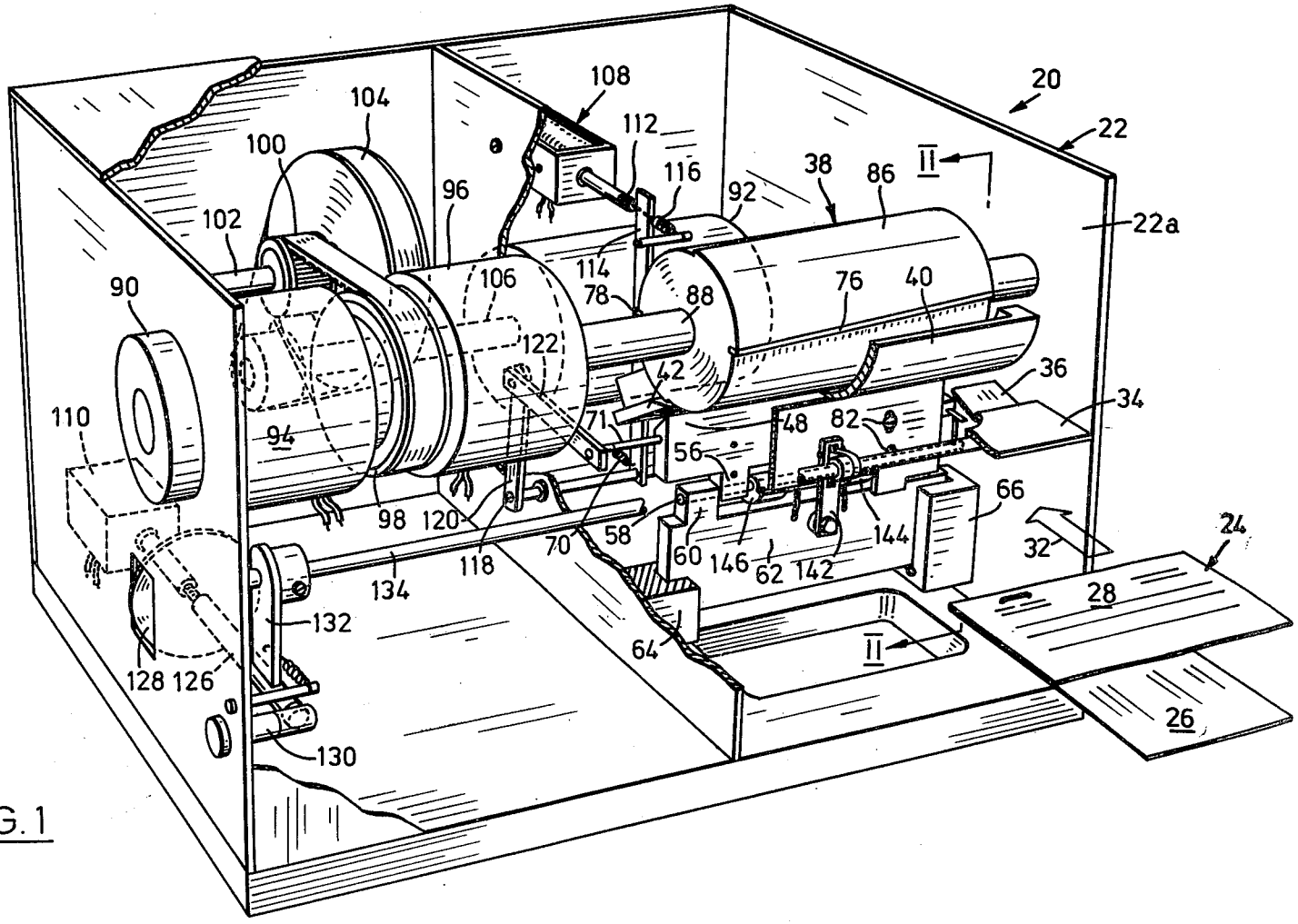

Referring first to FIG. 1, the apparatus as a whole is generally denoted by reference numeral 20 and has a casing 22, part of the top and front of which is shown broken away to reveal internal structure. The front wall of the casing (not shown) is formed with a narrow rectangular slot into which can be inserted sheet-form material having a staple to be removed by the apparatus. By way of example, a remittance set is shown in FIG. 1 preparatory to being inserted through the slot. The set is generally indicated by reference numeral 24 and typically includes a cheque 26 and a remittance advice 28 secured together by a staple 30. For convenience of description, reference will be confined to a "sheet" in describing the construction and operation of the apparatus; however, this term is to be understood as including both single sheets carrying a staple, and sets of sheets such as the remittance set 24. Reference numeral 24 will continue to be used to denote the "sheet".

In FIG. 1, the arrow denoted 32 indicates the general direction in which the sheet 24 is inserted into the apparatus. Immediately inside the front wall of casing 22 and behind the slot in the wall is a "deck" or guide 34 over which the sheet 24 passes into the operative parts of the apparatus. A relatively thin and flexible stainless steel plate 36 is secured to the under-side of deck 34 and serves both to guide the sheet 24 as it is inserted, and to assist in removing parts of the staple 30 when the sheet is withdrawn. Thus, the intention is that the sheet or sheets carrying the staple to be removed, will be simply inserted through the slot in the front wall of the casing of the apparatus, left in place while the staple is removed, and then withdrawn and passed on to the next stage in the mail processing system.

Before describing the remainder of FIG. 1 in detail, it may be convenient to refer to FIGS. 2, 3 and 4 in describing the principal components of the apparatus and their operation. These views may be considered to be end views generally in the directions of arrows ii—ii of FIG. 1, showing sequential stages in the operation of the apparatus.

Referring first to FIG. 2, the sheet 24 is shown having been inserted into the apparatus to an initial position. A rotary knife for cutting the staple 30 is generally denoted by reference numeral 38. Sheet 24 is shown inserted into an elongate opening defined between the flexible stainless steel plate 36 below deck 34 and a guard 40 for the rotary knife. It will be seen that the apparatus is designed so that the sheet can be inserted generally in a flat plane with the staple 30 extending generally transverse to the direction of insertion (as represented by arrow 32 in FIG. 1). The plane is denoted P in FIG. 2. Sheet 24 is inserted generally in plane P until it reaches an anvil 42 which deflects the leading end portion of the sheet 24 downwardly out of plane P. The anvil has a generally wedge-shaped leading end including a leading edge 44 disposed in plane P and extending generally normal to the direction of insertion of sheet 24. The anvil also has a lower surface 46 which extends from the leading edge 44 downwardly, at an angle of approximately 30 degrees to plane P and by which the sheet is deflected downwardly.

Sheet 24 continues to move inwardly until the portion of staple 30 below the sheet contacts stop means represented by a tongue 48. The tongue also has a generally wedge-shaped end, terminating at a staple locating end edge 50. This edge is defined by a vertical face 52 and by an inclined top face 54 of the tongue. Tongue 48 is also visible in FIG. 1 and it will be seen that the tongue extends over the entire axial length of the rotary knife 38. This length is selected to exceed the anticipated width of typical sheets to be inserted into the apparatus (as sheet 24).

With continued reference to FIG. 1, it will be seen that tongue 48 is of generally rectangular shape in elevation but has two depending lugs, one of which is visible at 56, and by which the tongue is mounted on a horizontal pivot shaft 58. Shaft 58 also passes through a pair of corresponding lugs, one of which is visible at 60, which project upwardly from a plate 62. Plate 62 is mounted for vertical sliding movement in a pair of guide blocks 64, 66 secured to the right hand side wall 22*a* and a centre wall 22*b* of casing 22.

The purpose of this vertically slidable plate 62 will be described later. For present purposes, it is sufficient to note that shaft 58 permits tongue 48 to pivot back and forth about the axis of the shaft. Thus, by a comparison of FIGS. 2 and 3, it will be seen that, in FIG. 3, tongue 48 has pivoted to the right (rearwardly of the apparatus as a whole) as compared with its position in FIG. 2. The tongue is normally biassed towards its vertical position by a tension spring 70, which extends between a pin 71 projecting from the inner end of the tongue parallel to shaft 58, and a fixed part of the apparatus (not shown). The tension in the spring 70 is relatively light so that the act of inserting the sheet 24 into the apparatus is sufficient in itself to cause the tongue to pivot rearwardly to the position shown in FIG. 3, as a result of abutment between the staple 30 and the end edge 50 of the tongue.

In this position (FIG. 3), the staple 30 is disposed on the inclined face 46 of anvil 42 displaced from the leading edge 44 of the anvil. Typically, staple 30 will be inclined with respect to the vertical face 52 of tongue 48 at this time (e.g. at an angle of about 30°) and it is necessary to tilt the staple so that it lies flat on face 52. This is achieved by causing tongue 48 to move against the surface 46 of the stationary anvil so that the edge 50 of tongue 48 indents the sheet 24 directly adjacent to staple 30. This has the effect of causing the staple to pivot on anvil surface 46 so that the staple is oriented flat against face 52 as best seen in FIG. 3*b*.

Tongue 48 is then returned to the vertical position as shown in FIG. 4. This has the effect of moving staple 30 (and with it sheet 24) counter to the direction in which the sheet was inserted, until the portion of the staple above sheet 24 is located adjacent the leading edge 44 of anvil 42. At the same time, the portion of the staple below sheet 24 is located adjacent the leading edge 50 of tongue 48. The staple is then properly located for cutting by the rotary cutter 38 but it is necessary to raise the staple into the path of the cutter to ensure that the staple is cut at the proper locations.

With continued reference to FIG. 3, it will be seen that the rotary knife 38 includes two circumferentially relieved portions 72 and 74 in advance of two diametrally opposed cutting blades 76 and 78. The blades are made of carbide and are replaceable. It will be seen from FIG. 1 that each blade extends over the full axial length of the knife and is disposed at an inclination to the axis of the knife, typically of about 4 degrees. The clearance between the leading edge of anvil 42 and the non-relieved portions of the rotary knife is between 0.001–0.002 inches and each relieved portions 72, 74 extends over a distance corresponding to 90 degrees of arc at the center of the roller and is of a depth of 0.031 inches.

In the position shown in FIG. 2, one of the knife blades (in this case blade 76) is shown in a position approximately 20 degrees past the leading edge 44 of anvile 42, considering the rotary knife turning counterclockwise as shown. At this time, the clearance between the leading edge of the anvil and the knife is at its minimum.

Immediately after the tongue 48 has indented the sheet 24 against the inclined surface 46 of anvil 42, knife 38 turns clockwise to bring one of the relieved portions of the rotary knife (in this case portions 72 in advance of knife 76) to a position above the leading edge of anvil 42. The knife is shown in this position in FIG. 3. A clearance of 0.032–0.033 inches then exists between the leading edge of anvil 42 and the rotary knife and the next step is to displace the staple upwardly and cause it to protrude into this space (tongue 48 being in its vertical position). This is effected by a plate 80 which is slidably mounted on the flat front face of tongue 48. In fact, the plate is secured to tongue 48 by four shouldered bolts, two of which are visible at 82 in FIG. 4, passing through vertically elongated slots in the plate. The top edge of plate 80 is relieved in the inner side as shown at 84 so as to in effect form a "pocket" for the staple. Thus, when plate 80 is displaced vertically with respect to tongue 48, the plate engages the portions of staple 30 below sheet 24 and displaces the staple towards the sheet so that it protrudes from the top side of the sheet. A typical wire staple is of approximately 0.020 inches diameter and has an overall "height" of 0.075 inches. Allowing for a paper thickness of 0.010 inches, it has been found possible to cause the staple to protrude 0.010–0.020 inches above the top surface of the paper. The rotary knife 38 then rotates, cutting through the staple, and travelling to a position approximately 20 degrees beyond the leading edge of the anvil.

FIGS. 4 and 4*a* show the staple in position at the "cutting station" immediately before being cut by knife 76. FIG. 5 shows the staple 30 as it would appear in the configuration of FIG. 2, while FIG. 6 shows the staple after it has been displaced upwardly by plate 80 (FIG. 4). It will be seen that the staple is preferably oriented with its "bar" uppermost and with its "loops" at the bottom. In FIG. 6, the loops have been flattened and the bar has moved up into the relieved portions 72 of the rotary knife. Blade 76 is positioned ready to cut the staple. In this way, the knife 76 will cut the staple below the radii in the top corners below the bar. It has been found that the bar and top corners of the staple are then carried away with the rotary knife while the loops at the bottom of the staple and the bottom corner portions can readily fall away below. In this particular embodiment the intention is that the stainless steel strip 36 below the deck 34 will engage and remove the loops of the staple as the sheet 24 is withdrawn from the apparatus. A tray (not shown) will be provided below the rotary knife to catch both the portions of the staple removed by the rotary knife and the loops.

It should of course be understood that, while it has been found preferable to ensure that the staples are oriented with the bar uppermost as shown, this is not believed to be essential to satisfactory operation of the apparatus and that the staples may be properly removed even when reversed as compared with FIGS. 5 and 6.

Referring now to FIG. 1 in more detail, the rotary knife 38 comprises a solid cylindrical body 86 formed with the relieved surface portion 72, 74, and fitted with the replaceable knives 76 and 78. The body is mounted on a shaft 88 rotatably supported in bearings on casing 22; one of these bearing is visible at 90 in FIG. 1. Shaft 88 is, in turn, driven from an electric motor 92 under the control of a brake 94 and a clutch 96 both of which are electrically operated. A pulley 98 between the brake and clutch is driven by a toothed rubber belt 100 from an intermediate shaft 102 which is itself driven by a further rubber belt 104 from the output shaft 106 of motor 92. In this particular application, very precise control over the rotation of knife 38 is required and it is therefore considered necessary to provide for both brake and clutch control of the knife driving shaft 88. It will be appreciated from the preceding description that the knife is required to achieve a relatively high angular velocity in a short period of time in order to properly cut the staples, and to stop accurately and quickly after the cutting operation has been performed.

Timing of rotation of knife 38 may be achieved in various ways. Typically, a timing disc is provided on shaft 88 and has associated therewith a photoelectric cell and light source positioned on respectively opposite sides of the disc. The disc is apertured at selected locations so that the light source illuminates the photoelectric cell at appropriate times and provides control signals to the brake and clutch 94 and 96 respectively. However, for clarify of illustration, the timing arrangement has not been specifically illustrated.

The apparatus also includes two solenoids 108 and 110 for, respectively, pressing tongue 48 against the anvil, (FIG. 3) and subsequently raising the tongue and plate 80 (FIG. 4). Solenoid 108 is also shown in FIG. 3*a* and is coupled by a tension spring 112 to the upper end of a vertical arm 114. A second tension spring 116 normally maintains the arm generally vertical. At its lower end, arm 114 is coupled to a horizontal pivot shaft 118 (see also FIG. 1) to which a second vertical arm 120 is also coupled. An arm 122 extends forwardly from the top of arm 120 and is coupled to the pin 71 which projects from an end face of tongue 48.

Solenoid 108 is controlled by a microswitch 124 (FIG. 3) positioned to be operated when tongue 48 has been pivoted rearwardly by the staple in the incoming sheet 24. Switch 126 then energizes solenoid 108, causing the tongue to be pulled to the right in FIGS. 3 and 3*a* (rearwardly of the apparatus) to urge its top edge 50 against anvil 42 and indent sheet 24 as discussed above.

While solenoid 108 remains energized, the rotary knife turns to bring one of the relieved portions to a position above the leading edge of anvil 42 as discussed above.

Solenoid 110 is then energized. This solenoid has an actuating arm which extends forwardly and generally horizontally and which is denoted by reference numeral 126 in FIG. 1. Arm 126 is in two parts which can be adjusted axially by a thumb wheel 128 to vary the overall length of the arm. At its outer end, the arm slides in a support 130. Adjacent support 130, a lug 132 is pivotally coupled to and extends upwardly from arm 126 and is secured at its upper end to a shaft 134 which extends horizontally across the front of the apparatus. Shaft 134 is mounted to turn unsuitable supports (not shown) and extends across the apparatus in front of tongue 48 and the associated plate 80.

Referring now particularly to FIGS. 3 and 4, shaft 134 carries a collar 136 having a quadrant 138 which projects radially from shaft 134 towards tongue 48. At its outer end, the quadrant is received in a slot 140 (see also FIG. 1) in a vertical bar 142 secured at its lower end to the plate 62 below tongue 48. It will be recalled that this plate is vertically slideable in supports 64 and 66. Operation of solenoid 110 is arranged to retract arm 126 which, in turn, will cause shaft 134 to turn in the counterclockwise direction as seen in FIGS. 3 and 4. In turn, this will lift plate 62 by way of bar 42. It will be recalled that tongue 48 is coupled to plate 62 by shaft 58 so that the tongue will also be lifted.

Hinge pin 58 also carries a pair of cam elements 144 and 146, one of which (144) is visible in FIGS. 3 and 4. Each element turns freely on shaft 58 and has a pair of normally horizontal cam surfaces, denoted 144*a* and 144*b* in the case of element 144, disposed on opposite sides of tongue 48. Surface 144*a* bears against the lower face of a fixed bar 148 while surface 144*b* bears against the bottom edge of the vertically slideable plate 80 carried by tongue 48. It will be appreciated that, as the pivot shaft 58 is raised, along with plate 62 and tongue 48, cam surface 144*a* will contact bar 148, causing the cam element 144 to turn in the clockwise direction about shaft 58 as seen in FIGS. 3 and 4. Surface **144*b* will be raised correspondingly, causing plate 80 to be lifted faster than tongue 48. In this way, the plate 80 can move from a retracted position well clear of the top edge of tongue 48 (FIG. 2) to a position substantially even with that edge (FIG. 4). Two tension springs 150 (FIG. 1) extend between plate 80 and plate 62 for returning the plate when solenoid 110 is de-energized and tongue 48** can move down.

To summarize, as seen in FIG. 3, tongue 48 has been urged against anvil 42 by solenoid 108. That solenoid remains energized while solenoid 110 is energized, causing shaft 134 to lift plate 62. By virtue of the inclination of the lower surface of anvil 42, this upward movement of plate 62 causes anvil 48 to slide along the lower surface of the anvil until it reaches the substantially vertical position shown in FIG. 4. At the same time, plate 80 moves upwardly at a differential rate so that the staple is projected into the relieved portion of the rotary knife immediately after tongue 48 has arrived at its vertical position. The knife then cuts the staple into two longitudinal halves as discussed above and the solenoids 108 and 110 are de-energized, returning the components to the position shown in FIG. 2. The sheet 24 is then withdrawn through the front of the casing 22 and the remaining loops of the staple (if any) are stripped from the sheet by stainless steel plate 36 below deck 34.

It will of course be appreciated that the preceding description relates to a preferred embodiment of the invention only and that many modifications are possible within the broad scope of the invention.

For example, it is in its simplest form, tongue 48 need not be arranged to pivot rearwardly against anvil 42 but could be simply fixed in a vertical position, defining an abutment for a staple carried by an incoming sheet. However, a pivotted tongue is believed to be preferable in that it has been found to make for reliable operation of the apparatus where there is a variation in the force with which different sheets are inserted into the apparatus. Where a fixed tongue is used there may be a tendency for the staple to ride over the tongue unless the sheet is inserted carefully.

Also, while a rotary knife is to be preferred, it would be possible within the broad scope of the invention to use other forms of knife; for example, a generally horizontally slideable knife moving back and forth above the leading edge of the anvil.

It should also be noted that the apparatus need not be oriented as shown in the drawings; any orientation relative to a generally flat plane in which the sheet is inserted, may be possible.

I claim:

1. Apparatus for removing staples from sheet-form material, comprising:

means defining an opening into which a sheet can be inserted generally in a flat plane with a staple to be removed from the sheet extending generally transverse to the direction of insertion;

an anvil having a leading edge disposed generally in said plane and extending generally normal to said direction of insertion, said anvil being adapted to deflect out of said plane the leading end portion of a sheet inserted into the opening;

stop means adapted to locate the staple in said sheet at a cutting station with portions of said staple at a first side of the sheet against said anvil leading edge, said stop means having a staple locating edge extending parallel to said anvil leading edge and positioned for contact by portions of said staple at the second side of said sheet;

means adapted to engage the portions of the staple located against said stop means and displace the staple towards the sheet so as to cause the staple to protrude from said first side of the sheet; and, cutter means operable to slice through said protruding portions of the staple along a cut line generally parallel to said plane and in a direction towards said anvil whereby the staple is cut into portions which can separate from the sheet.

2. Apparatus as claimed in claim 1, wherein said anvil has a surface which extends from said leading edge at an inclination to said flat plane, and along which said leading end portion of a sheet is deflected, wherein said stop means comprises a tongue mounted for pivotal movement about an axis parallel to said staple locating edge between a first position in which said staple is located at said cutting station, and a second position in which said staple locating edge is disposed adjacent said anvil surface, for trapping said sheet against said surface, the tongue being moveable from said first position to said second position by abutment of said staple with the tongue as said sheet is inserted into the opening, and wherein the apparatus further comprises means for urging said tongue against said surface to indent the sheet and orient the staple generally in a plane normal to said sheet, and means for subsequently returning the tongue from said second position to said first position.

3. Apparatus as claimed in claim 2 oriented with said flat plane generally horizontal and with said tongue disposed below said plane and substantially vertical when in said first position, said anvil surface being inclined downwardly from said plane, and wherein said means for returning the tongue from said second position to said first position is operable to displace the tongue generally vertically whereby the tongue slides along said anvil surface in returning to its first position, thereby maintainiing said indentation of the sheet.

4. Apparatus as claimed in claim 2 wherein said means adapted to engage and displace the staple comprise a plate slideably mounted on said tongue for movement between a retracted position clear of said staple locating edge of the tongue, and an advanced position in which the staple has been engaged and displaced towards the sheet to cause the staple to protrude from the first side of the sheet.

5. An apparatus as claimed in claim 4 wherein said means for returning the tongue from its second position to its first position include cam means pivotally coupled to said tongue for displacement with the tongue, and wherein said cam means has first and second abutment surfaces disposed on respectively opposite sides of the tongue, said first surface being adapted to engage a fixed abutment as a consequence of vertical movement of the tongue towards said plane, and said second surface being adapted to engage and displace said plate relative to the tongue, whereby said plate is displaced at a differential rate with respect to said tongue from said retracted position to said staple engaging position.

6. Apparatus as claimed in claim 5, wherein said plate has an upper edge for contact with a staple, said edge being recessed adjacent said tongue for receiving said staple.

7. Apparatus as claimed in claim 1, wherein said cutter means comprises a rotary knife having a generally cylindrical body and an axis of rotation disposed generally parallel to said anvil leading edge and said staple locating edge, and at least one blade extending generally axially of said body, said body including a relieved portion extending in advance of said blade in the direction of rotation of the knife, whereby said knife can be disposed with said relieved portion at said cutting station prior to operation of the knife so that said staple can be displaced into said relieved portion.

8. Apparatus as claimed in claim 7, wherein said rotary knife has two blades disposed generally at diametrically opposed positions around said body, said body including a relieved portion in advance of each blade and each blade being disposed generally axially of but at a slight inclination to the axis of said body.

9. Apparatus as claimed in claim 1, wherein said means defining an opening includes a flexible plate over which said sheet is inserted and which is arranged to bear against said second side of the sheet, whereby said plate will assist in removing from said sheet any remaining portions of said staple when the sheet is withdrawn.

* * * * *